US007034701B1

(12) United States Patent
Rose-Pehrsson et al.

(10) Patent No.: US 7,034,701 B1
(45) Date of Patent: Apr. 25, 2006

(54) IDENTIFICATION OF FIRE SIGNATURES FOR SHIPBOARD MULTI-CRITERIA FIRE DETECTION SYSTEMS

(75) Inventors: Susan Rose-Pehrsson, Fairfax, VA (US); Ronald E. Shaffer, Clifton Park, NY (US); Daniel T. Gottuk, Ellicott City, MD (US); Sean J. Hart, Alexandria, VA (US); Mark H. Hammond, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 865 days.

(21) Appl. No.: 09/885,255

(22) Filed: Jun. 16, 2000

(51) Int. Cl.
*G08B 17/10* (2006.01)

(52) U.S. Cl. ..... 340/628; 340/521; 340/523; 340/539.27; 340/588; 340/589; 340/629

(58) Field of Classification Search ..... 340/628, 340/629, 630, 577, 578, 521, 522, 523, 511, 340/506, 588, 589
See application file for complete search history.

(56) References Cited

U.S. PATENT DOCUMENTS 4,749,987 A * 6/1988 Ishii ..... 172/642
5,168,262 A * 12/1992 Okayama ..... 340/523
5,237,512 A * 8/1993 Davidson ..... 702/73
5,349,541 A * 9/1994 Alexandro et al. ..... 703/18
5,670,938 A * 9/1997 Ohtani et al. ..... 340/506
5,691,703 A * 11/1997 Roby et al. ..... 340/628
5,751,209 A * 5/1998 Werner et al. ..... 340/286.05
5,832,187 A * 11/1998 Pedersen et al. ..... 706/45
5,910,765 A * 6/1999 Slemon et al. ..... 340/517
6,222,456 B1 * 4/2001 Tice ..... 340/630
2003/0017481 A1 * 1/2003 Golub et al. ..... 435/6

* cited by examiner

*Primary Examiner*—Daniel J. Wu
*Assistant Examiner*—Son Tang
(74) *Attorney, Agent, or Firm*—John J. Karasek; Sally A. Ferrett; Chester L. Jordan

(57) ABSTRACT

A multi-criteria fire detection system, comprising a plurality of sensors, wherein each sensor is capable of detecting a signature characteristic of a presence of a fire and providing an output indicating the same. A processor for receiving each output of the plurality of sensors is also employed. The processor includes a probabilistic neural network for processing the sensor outputs. The probabilistic neural network comprises a nonlinear, nor-parametric pattern recognition algorithm that operates by defining a probability density function for a plurality of data sets that are each based on a training set data and an optimized kernel width parameter. The plurality of data sets includes a baseline, non-fire, fist data set; a second, fire data set, and a third, nuisance data set. The algorithm provides a decisional output indicative of the presence of a fire based on recognizing and discrimination between said data sets, and whether the outputs suffice to substantially indicate the presence of a fire, as opposed to a non-fire or nuisance situation.

4 Claims, 4 Drawing Sheets

IDENTIFICATION OF FIRE SIGNATURES FOR SHIPBOARD MULTI-CRITERIA FIRE DETECTION SYSTEMS

FIELD OF THE INVENTION

This invention relates in general to the field of fire detection systems, and in particular to the field of fire detection using multiple sensors monitoring various physical and chemical parameters, the output thereof being analyzed and classified by means of a processor employing a probabilistic neural network to determine if a fire whether or not an fire condition is present.

BACKGROUND OF THE INVENTION

With the advent of automated systems for fire prevention and fire fighting, the need to improve fire detection systems by means of providing fast, accurate and reliable fire detection systems has increased. For example, the U.S. Navy program Damage Control-Automation for Reduced Manning (DC-ARM) is focused on enhancing automation of ship functions and damage control systems. A key element to this objective is to improve its current fire detection systems. As in many applications, it is desired to increase detection sensitivity, decrease the detection time and increase the reliability of the detection system through improved nuisance alarm immunity. Improved reliability is needed such that the fire detection systems can provide quick remote and automatic fire suppression capability. The use of multi-criteria based detection technology continues to offer the most promising means to achieve both improved sensitivity to real fires and reduced susceptibility to nuisance alarm sources. One way to accomplish this is to develop an early warning system that can process the output from sensors that measure multiple signatures of a developing fire or from analyzing multiple aspects of a given sensor output (e.g., rate of rise as well as absolute value).

The microprocessor has led to an explosion of sensor technology available for fire detection. Sensors that detect levels of CO, $CO_2$, $H_2$, Hydrocarbons, HCL, HCN, $H_2S$ $SO_2$, $NO_2$, Temperature, Humidity etc. are useful in the detection of some of the chemical and physical signatures for various types of fires, as well as Photoelectric and Ionization smoke detectors. When coupled with a microprocessor, these sensors produce digital output that can be quantified and processed as raw data. This sensor technology is readily available.

One or more of these sensors can be combined in a system to create an array, or sensor package with will monitor and detects various characteristic signatures for a fire and provide a block of data that can be processed to determine if a fire exist. However, often some of the various parameters used to detect fires overlap with non-urgent conditions, such as burned toast, thus causing a system to issue a fire condition/alarm when one of an urgent nature does not exist. These are known generally as nuisance alarms, and often have the effect of reducing the efficiency of response to actual fires through misallocation of fire fighting resources or though general apathy by eroding confidence in the accuracy of the fire detection and alarm system.

One way to address this is through the accurate and efficient processing of the data provided by the sensor array. Thus there exist a need for a system and method to efficiently process data and quickly identify fire signatures from a multi-criteria fire detection sensor array.

SUMMARY OF THE INVENTION

A multi-criteria fire detection system, comprising a plurality of sensors, wherein each sensor is capable of detecting a signature characteristic of a presence of a fire and providing an output indicating the same. A processor for receiving each output of the plurality of sensors is also employed. The processor includes a probabilistic neural network for processing the sensor outputs. The probabilistic neural network comprises a nonlinear, nor-parametric pattern recognition algorithm that operates by defining a probability density function for a plurality of data sets that are each based on a training set data and an optimized kernel width parameter. The plurality of data sets includes a baseline, non-fire, fist data set, a second, fire data set; and a third, nuisance data set. The algorithm provides a decisional output indicative of the presence of a fire based on recognizing and discrimination between said data sets, and whether the outputs suffice to substantially indicate the presence of a fire, as opposed to a non-fire or nuisance situation.

DETAILED DESCRIPTION

Figure 1:
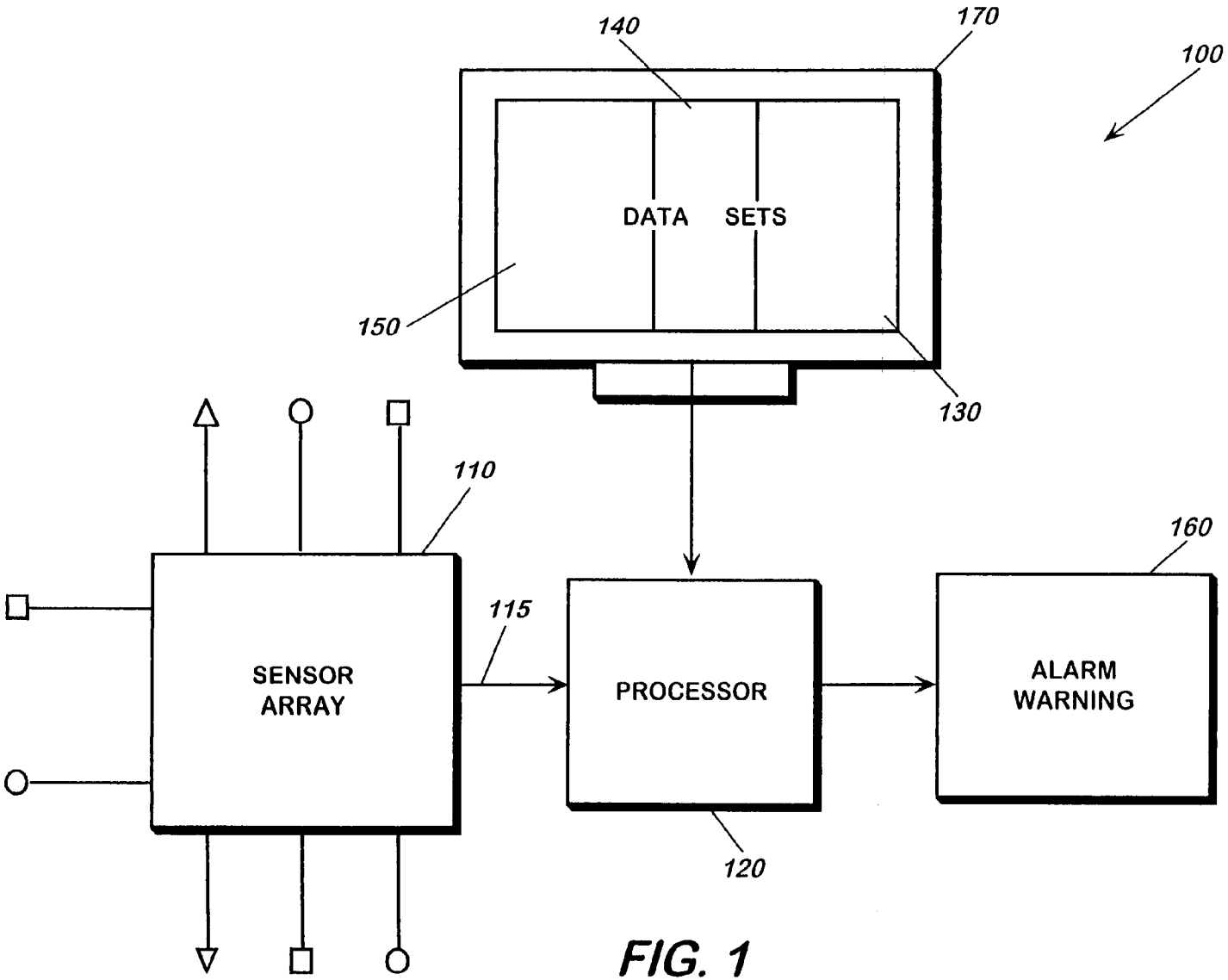
FIG. 1 is a block diagram of the fire detection system.

Referring now to the figures wherein like reference numbers denote like elements, FIG. 1 is a block diagram of the fire detection system. As shown in FIG. 1, the multi-criteria fire detection system 100, comprises a plurality of sensors or sensor array 110. Each sensor within sensor array 110 is capable of detecting a signature characteristic of a presence of a fire and providing an output indicating the same. A processor 120 for receiving each output of the plurality of sensors is also employed and coupled to sensor array 110. The processor 120 includes a probabilistic neural network for processing the sensor outputs 115. The probabilistic neural network comprises a nonlinear, nor-parametric pattern recognition algorithm that operates by defining a probability density function for a plurality of data sets 170 that are each based on a training set data and an optimized kernel width parameter. The plurality of data sets 170 includes a baseline, non-fire, fist data set 140; a second, fire data set 150; and a third, nuisance data set 130.

The algorithm provides a decisional output indicative of the presence of a fire based on recognizing and discrimination between said data sets, and whether the sensor outputs suffice to substantially indicate the presence of a fire, as opposed to a non-fire or nuisance situation. Upon the detection of conditions, which suffice to substantially indicate the presence of a fire, an alarm or warning condition is issued.

The fire detection system 100 features a processor 120 with employs an probabilistic neural network algorithm that comprises a single optimized kernel width parameter that along with the one of said training set data defines the probability density function for each of the plurality of data sets. In other embodiments the algorithm further comprises a cross-validation protocol.

The algorithm employs a method detecting the presence of fire, comprising the steps of establishing a plurality of data sets which include 1) a baseline, non-fire, first data set 140; 2) a second, fire data set 150; and 3) nuisance data set 130. Each of the data sets are then trained to respond to an input and provide a representative output. Sensing a plurality of signatures of a fire and encoding each of said plurality of signatures in a numerical output representative of a point or location in a multidimensional space. Inputting each said numerical output to a probabilistic neural network that operates by defining a probability density function for each said data set based on the training set data and an optimized kernel width parameter. Correlating the numerical outputs to a location in multidimensional space, and finally, determine the presence or absence of a fire at a particular location.

One the raw data is collected from the various sensors, the data must be analyzed. This involves three task. First the data is initially processed. Second the data is subjected to a univariate data analysis. The third step is a multivariate analysis. The initial data processing prepares the test data for use in both the univariate and multivariate analysis.

During the initial processing the data is converted into engineering units, such that gas concentrations are recorded for example, as units of parts per million (ppm). Smoke measurements may be recorded as percent obscuration per meter or other standard unit, and Temperature is recorded in some standard unit of measure such as degrees Celsius.

The ambient value for each sensor is calculated as the average value for some time period prior to source initiation. In a preferred embodiment the ambient value for each sensor is calculated as the average value for a period of approximately 60 seconds prior to source initiation.

The goal of the univariate data analysis is to provide a first cut evaluation of the sensors in order to identify which may have value as independent signatures. A candidate signature indicates a statistically significant degree of discrimination between the real fire scenarios and the nuisance source scenarios. These candidate signatures are potentially useful in a multi-criteria alarm algorithm which is a voting type algorithm. The univariate analysis identified the candidate sensors that show discrimination between real and nuisance events based on the discrete data sets corresponding to different smoke detector alarm levels.

The first step of the analysis is to obtain a set of descriptive statistics for each sensor channel for both real and nuisance events. These statistics include the mean, minimum and maximum values, median value, the 95% confidence interval and the variance for each sensor at a given alarm threshold.

A sensor is determined to discriminate real from nuisance events if the mean values are significantly different for each of the fire and nuisance scenario. If the means values for both real and nuisance events was identical or within a particular range of similarity, the sensors are determined not to be able to discriminate real from nuisance events. The criteria for determine sensor discrimination are: 1) The mean sensor value, and 2) the probability statistic (p).

The mean sensor value is a mean for both real and nuisance events with the respective standard errors (standard errors take into account the sample size to reduce the error associated with the mean estimate, the sample error is smaller than the standard deviation).

The probability statistic (p) is a value taken from statistical tables that corresponds to the F-Ratio value and the degrees of freedom. The p value will be 0.05 to determine the significance for this analysis (95% significance).

In the preferred embodiment a candidate sensor has a significant difference between its fire and nuisance source events when the reported averages for each event meet the following criteria. First the reported probability statistic is less than 0.05, indicating a significant difference in the means and the 95% confidence level, and second, the distribution of the data at the 95% confidence interval did not overlap extensively.

Figure 2:
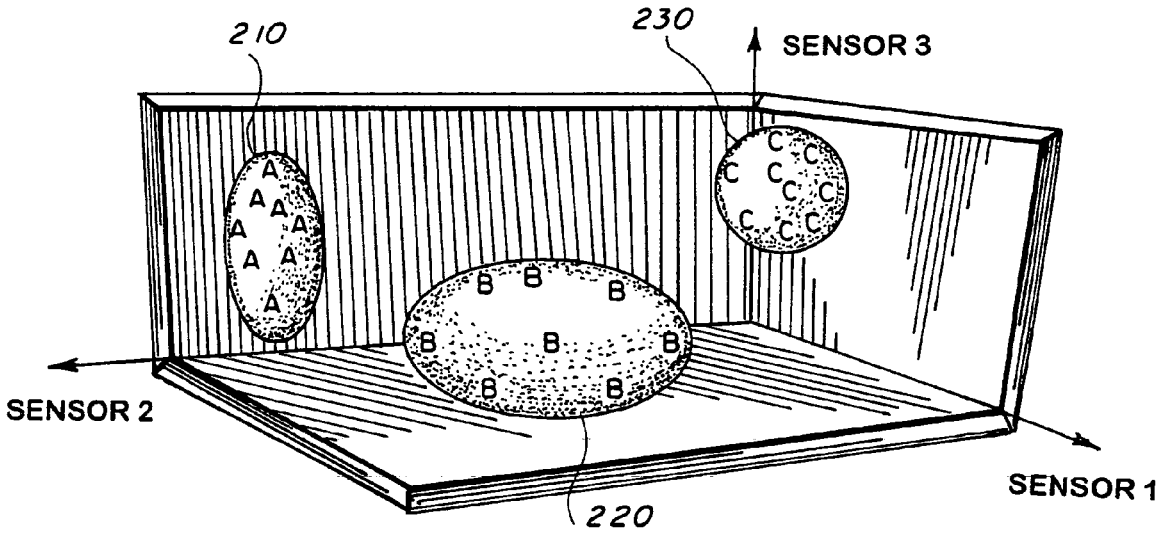
FIG. 2 shows an example of a conceptual picture of a pattern space consisting of a three sensor array.

The next step is a multivariate analysis. Multivariate classification or pattern recognition techniques, as applied to sensor data for fire detection is described as follows. The sensors encode chemical information about a fire in a numerical form. Each sensor defines an axis in a multidimensional space as shown in FIG. 2. Events such as fires and nuisance sources are represented as points (A, B or C) positioned in this space according to sensor responses.

FIG. 2 shows a conceptual diagram of an example pattern space consisting of a three-sensor array and three classes of events. Class A, 210 could be, for example, a nonfire or baseline event, Class B, 220 could be different types of fires and Class C. 230 could be nuisance sources. In the preferred embodiment the sensors are chosen such that, similar events will tend to cluster one another in space. Multivariate statistics and numerical analysis methods are used to investigate such clustering to elucidate relationships in multidimensional data sets without human bias. Also, the multivariate classification methods serve to define as mathematical functions the boundaries between the classes, so that a class of interest can be identified from other events. Applications of these methods are used to reduce false alarm rates and provide for early fire detection.

Sensor arrays consisting of several sensors measuring different parameters of the environment produce a pattern or response fingerprint for a fire or nuisance event. Multivariate data analysis methods are trained to recognize the patter of an important event, such as a fire. Generally it is not practical for a sensor system to have an infinite number of sensors because the costs associated with maintenance and calibration are often prohibitive. It is also not practical to have sensors that are highly correlated in an array because they do not contribute new information or unique information about the environment. Thus the sensors used in analysis and for sensor fusion must be chosen to provide useful and distinctive information.

In a preferred embodiment the selection of sensors is accomplished by applying cluster analysis algorithms to the type of data they provide. The sensor responses to events and nonevents are investigated using these methods. These are data driven techniques that look for relationships within the data; thus allowing for the determination of the best sensors for a particular application based on the sensor responses. Cluster analysis or unsupervised learning methods may be used to determine the sensors contributing to the maximum variation in the data space. The output of these algorithms ranks the sensors according to their contribution and combine sensors that are similar.

The results of these methods allow one to select the appropriate number and type of sensors to be used in building a system. These techniques can also be used to eludicate the underlying parameters that correlate with the fire event.

Multivariate classification is used to identify a fire and to discriminate fires from nonfires and nuisance sources. This type of classification relies on the comparison of fire events with nonfire events. These methods are considered supervised learning methods because they give both the sensor responses and correct classification of the events. Variations in the responses of sensors scan be used to train an algorithm to recognize fire events when they occur. A key to the success of these methods is the appropriate design of the sensor array.

The fire event is important, but the ability to recognize an event require knowledge of what a nonevent looks like. Thus one need to have data sets that balance the characteristics of nonevent with those of actual fire events. This balance allows one to train the system to recognize events of interest as quickly and accurately as possible. The number of possible analysis and event scenarios can be staggering when considering both fire events and nonevents. Thus the issue becomes not only one of which analysis to search for in a chemical detection system, but also at what concentrations and which combinations of analysis concentrations can be used as a positive indication of a target event.

The classifier used in this system is a Probabilistic Neural Network (PNN) that was developed at the US Naval Research Laboratory for chemical sensors arrays.

As disclosed earlier in the specification, a data base consisting of the responses of a multitude of sensors to several different types of fires and nuisances sources is analyzed using a variety of methods. This data base, in a preferred embodiment comprises background or baseline data, data collected prior to the start of a fire/nuisance event. Data surrounding the source ignition/initiation, and progression through termination is collected.

In the initial processing, this information is used to produce a matrix. In an example embodiment, the data is collected from 20 sensors and consist of 64 different test, then a matrix of 20×37635 is formed (37635 represents the one second time step data of all 64 test). Each row of the matrix is a pattern vector, representing the responses of the 20 sensors to a given source at a given point in time.

Next, 3 data matrices are developed at discrete times corresponding to the different alarm levels of a photoelectric smoke detector. The alarm time represent 0.82%, 1.63% and 11% obscuration per meter. The data sets are organized into three classes representing the sensor responses for baseline (nonfire), fire and nuisance sources. The baseline data represents the average of the initial 60 second of background data for each fire and nuisance source test. The PNN classifier is trained to discriminate between the 3 classes. All of the matrices were autoscaled, and the linear correlation between sensors is examined for each data set by calculating the correlation matrix. The data sets are studied using display and mapping routines, cluster analysis and PNN classification.

A useful step in the multivariate analysis is to observe the clustering of the data in multi dimensional space. Because it is impossible to imagine the data points clustering in n-dimensional space, display, mapping and cluster analysis is used. Three algorithms are used to provide an interpretable view of the multi dimensional data space. These algorithms are the principal component analysis, hierarchical cluster analysis and correlation matrix. Principal Component Analysis (PCA), also known as the Karhunen-Loeve transformation, is a display method that transforms the data into two- and three-dimensional space for easier visualization. PCA finds the axes in the data space that account for the major portion of the variance while maintaining the least amount of error.

Figure 3:
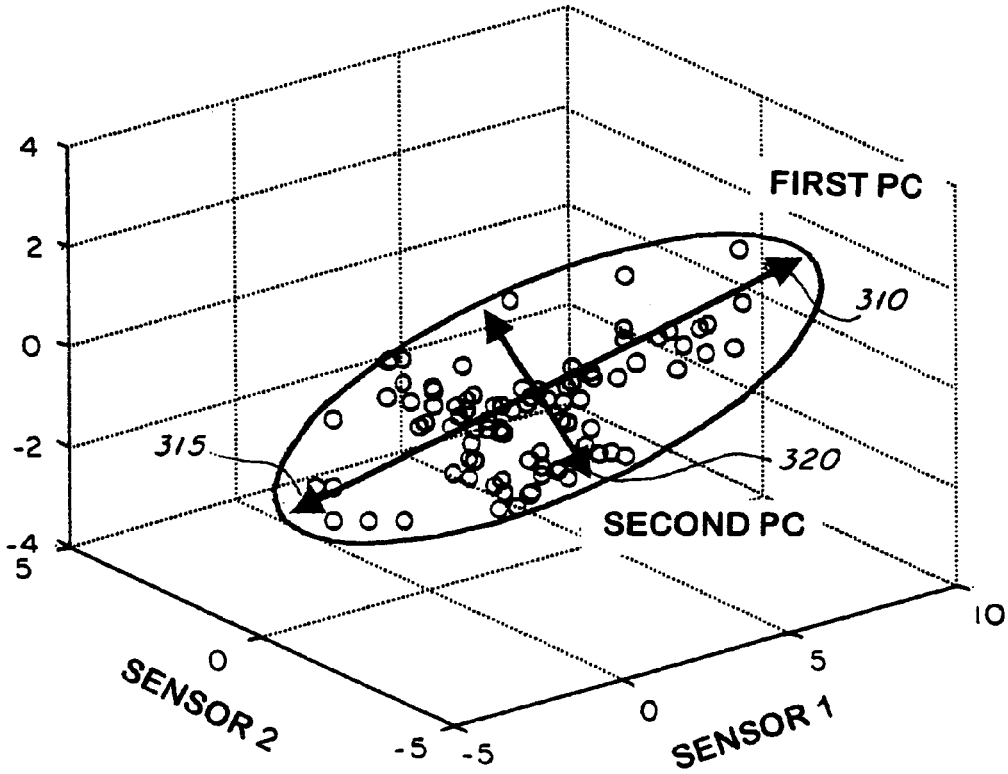
FIG. 3 shows an example of the values of three variables measured on a collection of samples as a three-dimensional representation of the Principle Component Analysis.

FIG. 3 shows an example of the values of three variables measured on a collection of samples as a three-dimensional representation of the Principal Component Analysis. Principal component 1 (First PC) 310, describes the greatest variation in the data set, and is the major axis 315 in the ellipse. The Principal Component 2 (Second PC) 320 describes the direction of the second greatest variation, which is the minor axis 325 of the ellipse. Mathemically, PCA computes a variance-covariance matrix for the stored data set and extracts the eigenvalues and eigenvectors. PCA decomposes the data matrix as the sum of the outer product vector, referred to as loadings and scores. The scores contain information on how the test or events relate to each other. PCA is used here to display the data and to select a subset of sensors (variable reduction).

Hierarchical cluster analysis, is used to investigate the natural groupings of the data based on the responses of the sensors. Cluster techniques which are unsupervised learning techniques because the routines are given only the data and not the classification type, group events together according to a Mahalanobis distance. Hierarchical cluster analysis group the data by progressively fusing them into subsets, two at a time, until the entire group of patterns is a single set. Two fusing strategies are used: 1) the k-nearest neighbor and 2) the k-means. The resulting data are displayed in dendorgams and are used to determine the similarities between sensor responses.

Classification methods are supervised learning techniques that use training sets to develop classification rules. The rules are used to predict classification of a future set of data, (i.e. realtime data received from the sensor array) These methods are given both the data and the correct classification results, and they generate mathematical functions to define the classes. The PNN method is preferably used. The PNN is a nonlinear, nonparametric pattern recognition algorithm that operates by defining a probability density function for each data class based on the training set data and the optimized kernel width parameter. The PDF defines the boundaries for each data class. For classifying new events, the PDF is used to estimate the probability that the new pattern belongs to each data class.

Figure 4:
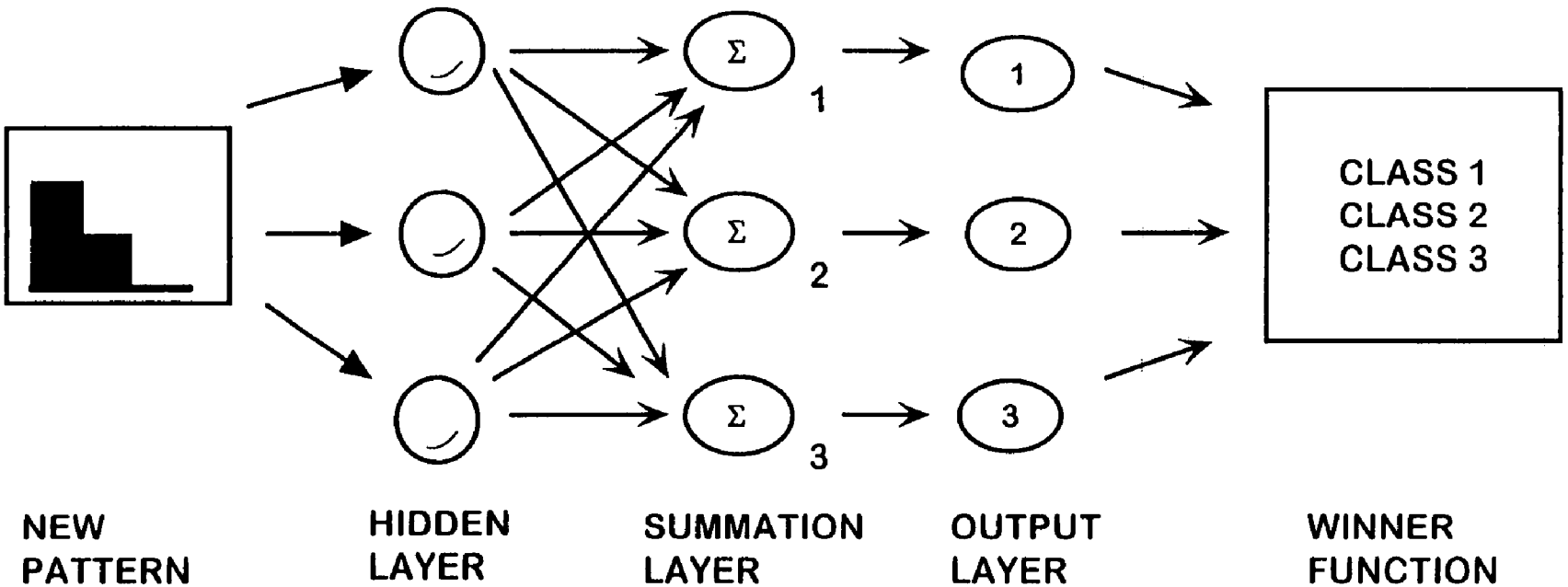
FIG. 4 shows the architecture or topology of the Probabilistic Neural Network (PNN).

FIG. 4 shows the architecture or topology of the Probabilistic Neural Network (PNN). The PNN operates by defining a probability density function (PDF) for each data class. For chemical sensor array pattern recognition, the inputs are the chemical fingerprints or pattern vectors. The outputs are the Bayesian posterior probability (i.e., a measure of confidence in the classification) that the input pattern vector is a member of one of the possible output classes.

The hidden layer of the PNN is the hear of the algorithm. During the training phase, the pattern vectors in the training set are simply copied to the hidden layer of the PNN. Unlike other types of artificial neural networks, the basic PNN only has a single adjustable parameter. This parameter, termed the sigma ($\sigma$) or kernel width, along with the members of the training set define the PDF for each data class. Other types of PNN's that employ multiple kernel widths (e.g., one for each output data class or each input dimension) do not provide any performance improvement while adding complexity.

In a PNN each PDF is composed of Gaussian-shaped kernels of width $\sigma$ locate at each pattern vector. Cross validation is used to determine the best kernel width. The PDF essentially determines the boundaries for classification. The kernel width is critical because it determines the amount of interpolation that occurs between adjacent pattern vectors. As the kernel width approaches zero, the PNN essentially reduces to a nearest neighbor classifier. The point is illustrated by the contour plot in FIG. 5.

Figure 5A:
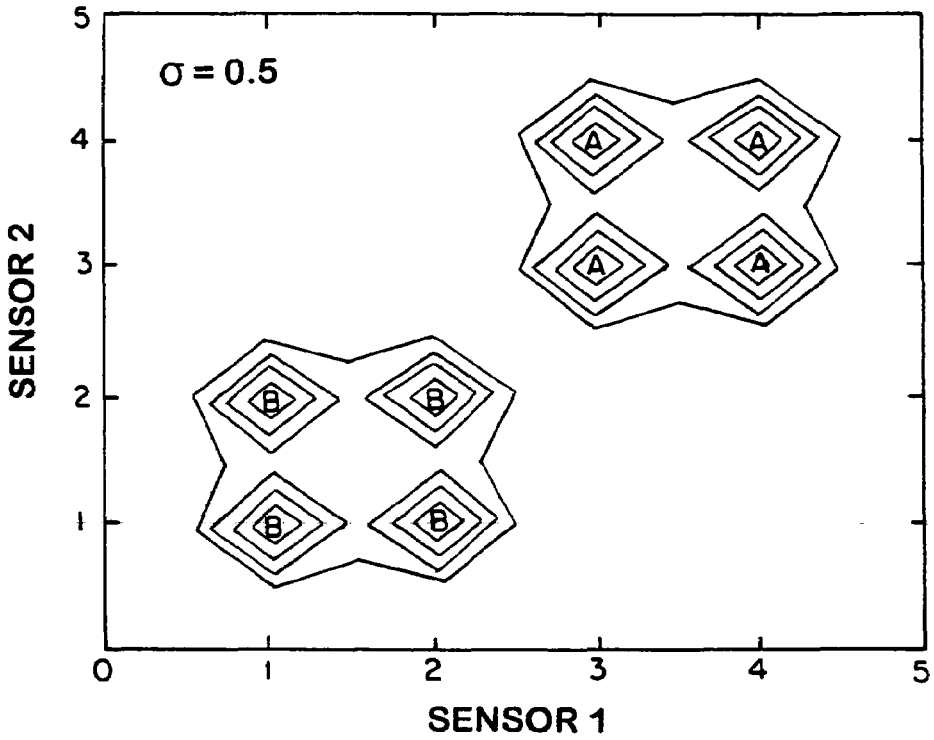
FIGS. 5A and 5B show an example of a contour plot illustrating the Probability Density Function (PDF) for two classes.
Figure 5B:
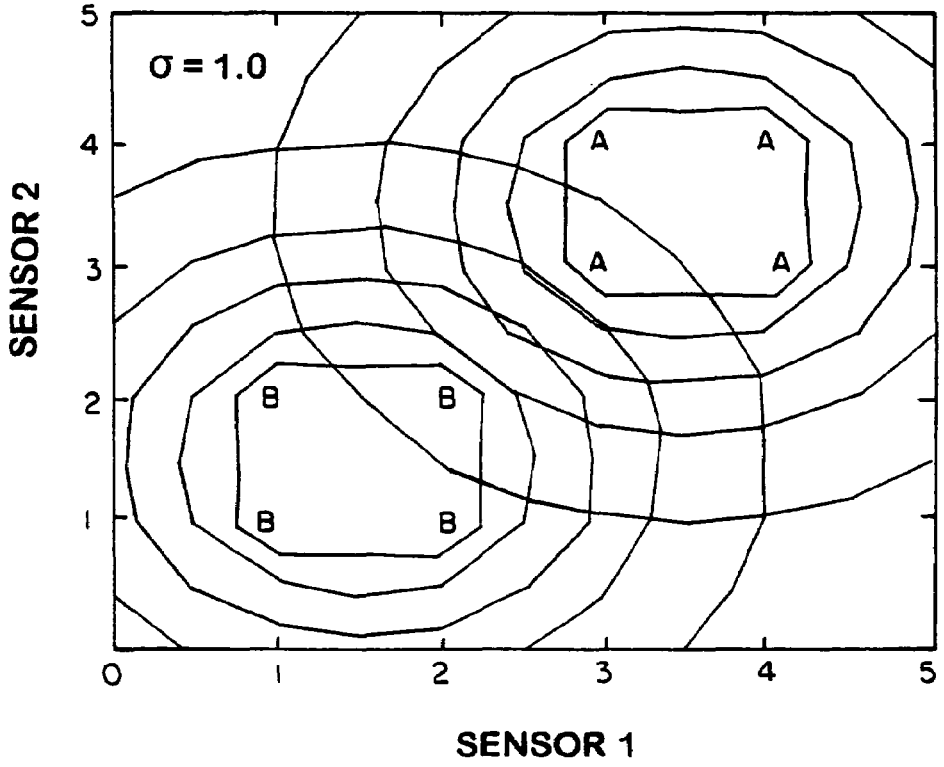

FIG. 5 shows an example of a contour plot illustrating the Probability Density Function (PDF) for two classes. These plots show four two-dimensional pattern vectors for two classes (A and B). The PDF for each class is shown as the circles of decreasing intensity. The probability that a pattern vector will be classified as a member of a given output data class (fire or nuisance) increases the closer it get to the center of the PDF for that class.

In the example shown in FIG. 5, any pattern vectors that occur inside the inner-most circle for each class would be classified with nearly 100% certainty. As σ is decreased (upper plot, 5A), the PDF for each class shrinks. For very small kernel widths, the PDF consist of groups of small circles scattered throughout the data space. A large kernel width (lower plot, 5B) have the advantage of producing a smooth PDF and good interpolation properties for predicting new pattern vectors. Small kernel widths reduce the amount of overlap between adjacent data classes. The optimized kernel width must strike a balance between a σ which is too large or too small.

Prediction of new patterns using a PNN, are generally more complicated than the training step. Each member of the training set of pattern vectors (i.e., the patterns stored in the hidden layer of the PNN and their respective classifications), and the optimized kernel width are used during each prediction. As new pattern vectors are presented to the PNN for classification, they are serially propagated through the hidden layer by computing the dot product, d, between the new pattern and each pattern stored in the hidden layer. The dot product scores are then processed through a nonlinear transfer function (the Gaussian kernel) expressed as:

$$\text{Hidden_Neuron_Output}=\exp(-(1-d)/\sigma^2)$$

The summation layer consist of one neuron for each output class and collects the outputs from all hidden neurons of each respective class. The products of the summation layer are forwarded to the output layer where the estimated probability of the new patter being a member of each class is computed. In the PNN, the sum of the output probabilities equals 100%.

The algorithm employs a method detecting the presence of fire, comprising the steps of establishing a plurality of data sets which include 1) a baseline, non-fire, first data set 140; 2) a second, fire data set 150; and 3) nuisance data set 130. Each of the data sets are then trained to respond to an input and provide a representative output. Sensing a plurality of signatures of a fire and encoding each of said plurality of signatures in a numerical output representative of a point or location in a multidimensional space. Inputting each said numerical output to a probabilistic neural network that operates by defining a probability density function for each said data set based on the training set data and an optimized kernel width parameter. Correlating the numerical outputs to a location in multidimensional space, and finally, determine the presence or absence of a fire at a particular location.

Although this invention has been described in relation to the exemplary embodiment's thereof it is well understood by those skilled in the art that other variations and modifications can be affected on the preferred embodiment without departing from scope and spirit of the invention as set fourth in the claims.

What is claimed is:

1. A multi-criteria fire detection system, comprising:

a plurality of sensors, wherein each said sensor is capable of detecting a signature characteristic of a presence of a fire and providing an output indicating same;

a processor for receiving each of said outputs of said plurality of sensors, said processor including a probabilistic neural network for processing said outputs, and wherein said probabilistic neural network comprises a nonlinear, non-parametric pattern recognition algorithm that operates by defining a probability density function for a plurality of data sets that are each based on a training set data and an optimized kernel width parameter, and wherein said plurality of data sets includes:

a baseline, non-fire, first data set;

a second, fire data set; and a third, nuisance data set;

whereby said algorithm provides a decisional output indicative of the presence of a fire based on recognizing and discriminating between said data sets and whether said outputs suffice to substantially indicate the presence of a fire as opposed to a non-fire or nuisance situation.

2. A system as in claim 1, wherein said algorithm comprises just one such optimized kernel width parameter that along with one of said training set data defines said probability density function for each said data set.

3. A system as in claim 2, wherein said algorithm further comprises a cross-validation protocol.

4. A method for detecting the presence of a fire, comprising the steps of:

establishing a plurality of data sets, said data sets including:

a baseline, non-fire, first data set;

a second, fire data set; and a third, nuisance data set;

training each of said data sets to respond to an input and provide a representative output;

sensing a plurality of signatures of a fire;

encoding each of said plurality of signatures in a numerical output representative of a point or location in a multidimensional space;

inputting each said numerical output to a probabilistic neural network that operates by defining a probability density function for each said data set based on said training set data and an optimized kernel width parameter; and correlating said numerical outputs to a location in said multidimensional space to determine the presence or absence of a fire at said location.

* * * * *